US005356297A

United States Patent [19]

Haskins

[11] Patent Number: 5,356,297

[45] Date of Patent: Oct. 18, 1994

[54] LAMP SOCKET AND TERMINAL THEREFOR

[75] Inventor: Steven W. Haskins, Sparta, Tenn.

[73] Assignee: Cooper Industries, Inc., Houston, Tex.

[21] Appl. No.: 30,716

[22] Filed: Mar. 12, 1993

[51] Int. Cl.[5] ..... H01R 23/72

[52] U.S. Cl. ..... 439/58; 439/699; 439/398; 439/419

[58] Field of Search ..... 439/56, 57, 58, 554, 439/557, 558, 419, 617, 619, 398, 699

[56] References Cited

U.S. PATENT DOCUMENTS

| | | | |
|---|---|---|---|
| 3,366,727 | 1/1968 | Rueger | 439/558 |
| 4,315,663 | 2/1982 | Olsson | 439/398 |
| 4,365,396 | 12/1982 | Baba et al. | 439/699 |
| 5,018,992 | 5/1991 | Bergin et al. | 439/699 |
| 5,160,277 | 11/1992 | Fitzgerald et al. | 439/554 |

FOREIGN PATENT DOCUMENTS

| | | | |
|---|---|---|---|
| 0259719 | 8/1988 | Fed. Rep. of Germany | 439/56 |

*Primary Examiner*—Gary F. Paumen
*Assistant Examiner*—Hien D. Vu
*Attorney, Agent, or Firm*—Burns, Doane, Swecker & Mathis

[57] ABSTRACT

A socket carries a lamp and is mountable into an opening of a circuit plate to make a connection between the lamp and a circuit of the circuit plate. The socket comprises a body in which electrical terminals are mounted. Wires which are joined to the lamp are connected to the electrical terminal. The electrical terminals make electrical contact with the circuit when the socket is inserted into the circuit plate. Each terminal includes a contact portion projecting forwardly from the body, and a shank portion mounted in the body. The contact portion has a through-slot therein such that the contact portion presents two relatively movable contact surfaces on opposite sides of the slot. The shank portion includes two slots for receiving and tightly gripping the wire.

23 Claims, 2 Drawing Sheets

LAMP SOCKET AND TERMINAL THEREFOR

BACKGROUND OF THE INVENTION

The present invention relates to a lamp socket adapted to be mounted in a circuit plate such as a printed circuit board or a flex circuit, and in particular, to an electric terminal for use in the socket.

Automobile dash panels typically have lamp assemblies mounted therein to provide visual indication and warning signals. The lamp assemblies are mounted in a circuit plate such as a printed circuit board or a flex circuit affixed to a panel. A common practice has been to provide a lamp assembly in the form of a socket and lamp, and attach the lamp assembly to the circuit plate by inserting the socket axially into an opening in the circuit plate, and then rotating the socket in order to lock the socket in the circuit plate. In so doing, electric terminals carried by the socket make electrical connection with the circuit, e.g., see Fitzgerald et al U.S. Pat. No. 5,160,277.

The terminals disclosed in that patent comprise an exposed upper contact portion and a shank portion which extends downwardly into the opening of the socket. The lower end of the shank portion is U-shaped, and a wire from the lamp is welded to the U-shaped portion. Although such a welded joint achieves a positive electrical connection with the lamp, the welding operation adds appreciable expense and effort to the manufacturing operation. Therefore, it would be desirable to enable the welding step to be eliminated without sacrificing the integrity of the electrical connection.

It is also important that good electrical connection be achieved between the terminals and the circuit of the circuit plate. The contact portion of each terminal described in the afore-mentioned patent comprises a generally arc-shaped plate presenting a convexly shaped contact surface which faces the circuit. When the socket assembly is installed in the circuit plate, the contact portion is depressed, and, in effect, rolls radially outwardly away from the socket axis so that the point of contact between the contact surface and the circuit is displaced along the contact surface. In effect, then, the contact surface slides radially along the circuit to wipe any oxide coating from the circuit to establish a positive electrical connection therewith.

Although the contact surface comprises a solid surface which is seemingly smooth, there will inherently exist minute irregularities (i.e., peaks and valleys) in the profile of the surface. It will be appreciated that the actual physical contact between the circuit and the contact surface will occur at only the three highest peaks which may, in effect, be considered to form together a point contact (as opposed to surface contact) between the circuit and terminal. If the oxide coating were not removed at that point, then the terminal could fail to make a proper electrical connection.

It would be desirable to provide greater assurance that a proper electrical contact will occur.

It would also be desirable to facilitate the insertion of the lamp/terminal assembly into the socket, and to effectively resist removal of that assembly from the socket.

SUMMARY OF THE INVENTION

The present invention relates to a socket for receiving a lamp to mount the lamp into a circuit plate which has an opening therethrough for receiving the socket. The socket comprises a body forming an aperture which is open at a forward axial end thereof for receiving the lamp. A locking mechanism is carried by the body for locking the socket to the circuit plate. Electrical terminals are disposed on the body for making electrical contact with a circuit carried by the circuit plate. Each terminal comprises a rear shank portion mounted in the body, and a contact portion projecting forwardly out of the body.

In one aspect of the invention, the contact portion includes a through-slot extending toward a forward end of the contact portion so that the contact portion presents relatively movable contact surfaces on opposite sides of the slot.

In another aspect of the present invention, a rear end of the shank portion includes first and second spaced apart legs in which are formed first and second slots, respectively. Each slot is open at one end thereof for receiving a wire connected to the lamp. Each slot is configured to apply a force to the wire for resisting dislodgement thereof.

Preferably, the body includes flanges projecting radially outwardly from a front end of the aperture. Each flange includes a radially extending depression. Each terminal includes a stop tap projecting from a junction of the shank and contact portion. The stop tab lies in the depression.

The locking mechanism preferably comprises snap arms which have camming surfaces for enabling the body to be installed into, and removed from, the circuit plate without being rotated about its longitudinal axis.

Preferably, one of the slots includes a pair of elastically flexible spring arms which grip the wire, the other of the slots having rigid walls which grip the wire. Preferably, the rigid walls are squeezed together during insertion of the terminals into the aperture.

BRIEF DESCRIPTION OF THE DRAWING

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
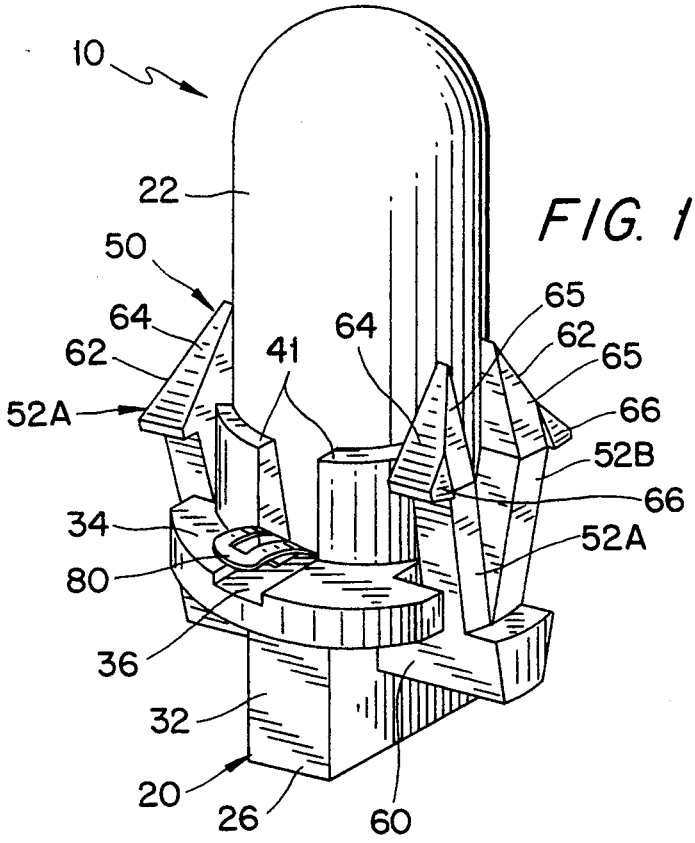
FIG. 1 is a perspective view of a socket assembly according to the present invention.
Figure 2:
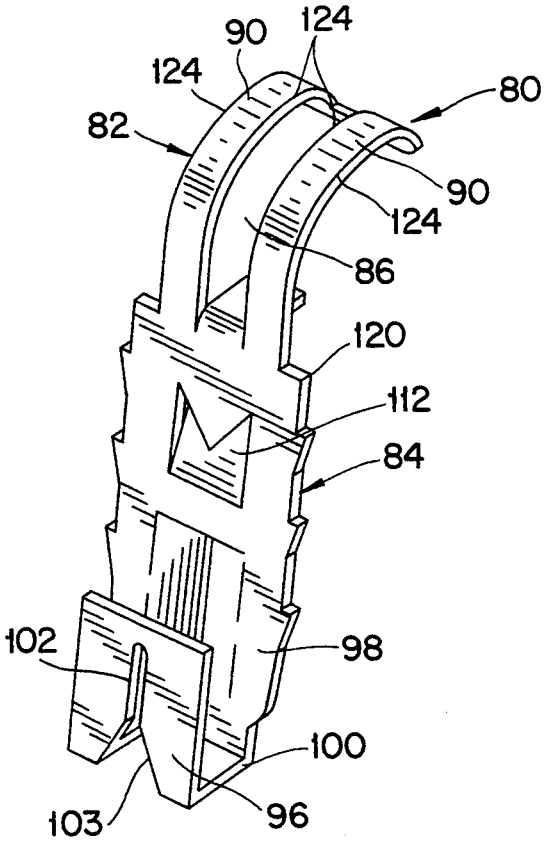
FIG. 2 is a perspective view of one side of an electrical terminal used in the socket assembly according to the present invention.

Depicted in FIG. 1 is a lamp assembly 10 which is to be mounted in a circuit plate CB (see FIG. 4) such as a printed circuit board or a flex circuit affixed to a panel.

The lamp assembly 10 comprises a socket 20 and a lamp 22 mounted in an aperture 24 (see FIG. 4) formed in a body 26 of the socket. The aperture 24 defines a longitudinal axis A and is open at its axially forward end to receive the lamp 22. The socket 20 is described in detail in the inventor's application Ser. No. 08/030,712, filed concurrently herewith, the disclosure of which is incorporated by reference herein.

The body includes a generally rectangular rear portion 32, and a pair of flanges 34 projecting radially outwardly from a front portion of the body. Formed in each flange 34 is a radial depression 36, which extends to the aperture 24. Projecting axially at a front end of the aperture are circumferentially spaced guide fingers 41 which guide and support the lamp 22.

Joined to the body 26 are two pairs 50 of spaced-apart snap arms 52A, 52B. The pairs 50 are spaced circumferentially apart by 180 degrees. The snap arms 52A, 52B of each pair are of identical configuration, and extend generally axially forwarded. Each snap arm includes a mounting end 60 jointed integrally with the body 26, and a free end on which a locking head 62 is formed. The snap arms are elastically flexible about their mounting ends, to enable the locking heads 62 to move toward and away from one another. The locking head 62 comprises cam follower faces 64, 65, 66 which face forwardly and are obliquely inclined relative to the axis A.

The socket 20 is installed in a circuit plate by being pushed forwardly into an opening thereof such that the snap arms 52A, 52B are cammed (via faces 64, 65, 66) to retracted positions enabling the locking heads 62 to pass through the opening. Then, the locking arms snap back to lock the body to the circuit plate. Removal of the socket is performed by pulling the socket rearwardly, whereupon the snap arms are again displaced to their retracted positions. Hence, the socket can be installed and removed without being rotated about the axis, as explained in detail in copending application Ser. No. 08/030,712.

When the socket is installed in the circuit plate CB, two diametrically opposed electrical terminals 80 carried by the body (only one terminal depicted) make electrical contact with the circuit C of the circuit plate. In accordance with the present invention, the terminal 80 comprises a contact portion 82 at its front end, and a shank portion 84 extending rearwardly into the aperture 24 of the body 26. The contact portion 82 extends radially outwardly from the aperture 24 and is bifurcated by means of a through-slot 86 which extends toward, but terminates short of, a front or free end 88 of the contact portion. Thus, the contact portion 82 presents a pair of spaced apart, relatively movable contact surfaces 90 which face forwardly and which are joined together at the front end of the contact portion. The contact surfaces 90 are disposed radially inwardly of the free end 88.

Figure 4:
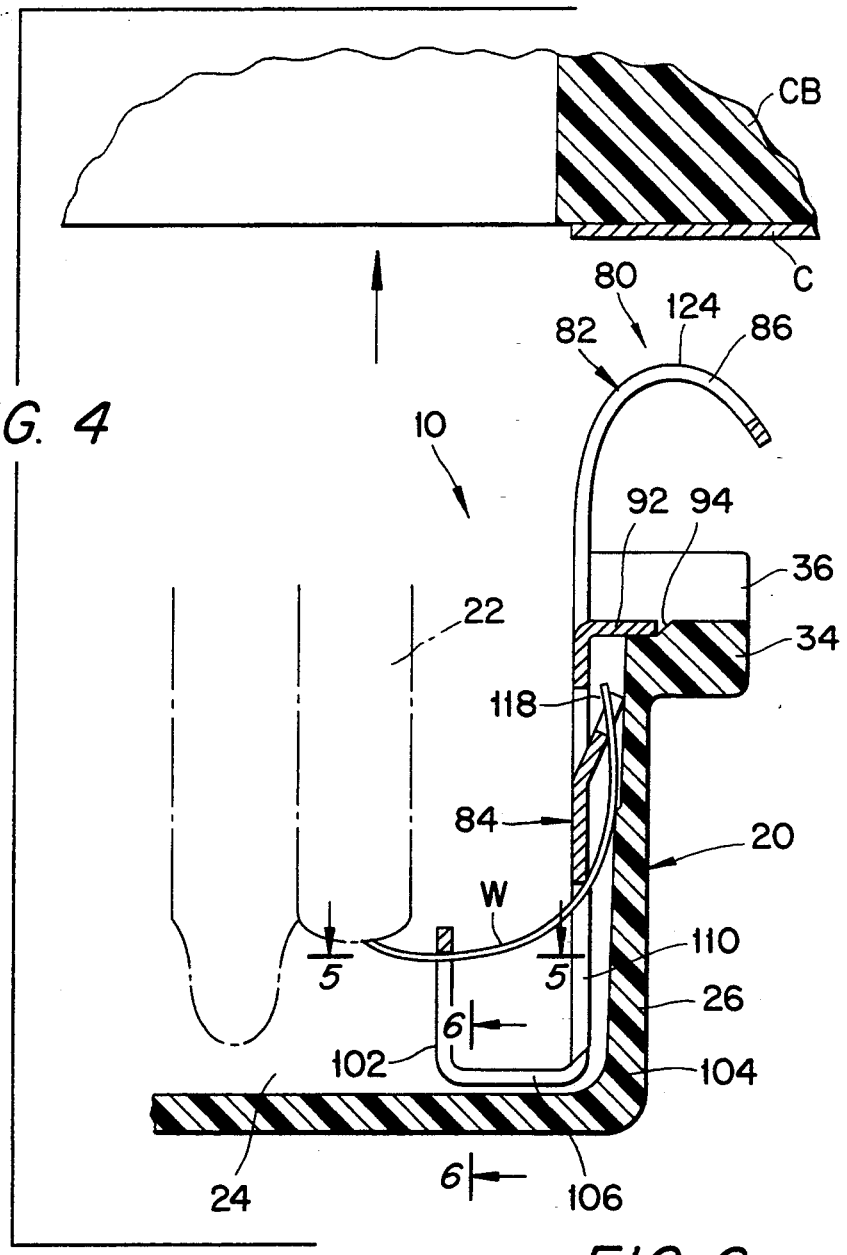
FIG. 4 is a vertical sectional view taken through a portion of a socket body, with a terminal mounted therein.

Projecting from a junction of the contact portion 82 and shank portion 84 is a stop tab 92 which lies in a groove 94 formed in the depression 36 (see FIG. 4). The stop tab 92 is superimposed behind the through-slot and engages the bottom of the groove 94 to define a limit for the insertion of the terminal.

The shank portion 84 terminates at its lower end in a U-shape so as to define a pair of parallel legs 96, 98 which are interconnected by a bight part 100. Extending into the leg 96 is a slot 102 having a tapered entrance 103, and extending into the leg 98 is a slot 104. Each of those slots 102, 104 is open toward the rear of the respective leg, and the slots 102, 104 are interconnected by a slot 106 formed in the bight part 100.

Figure 5:
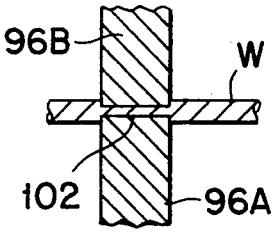
FIG. 5 is a sectional view taken along the line 5—5 in FIG. 4.
Figure 6:
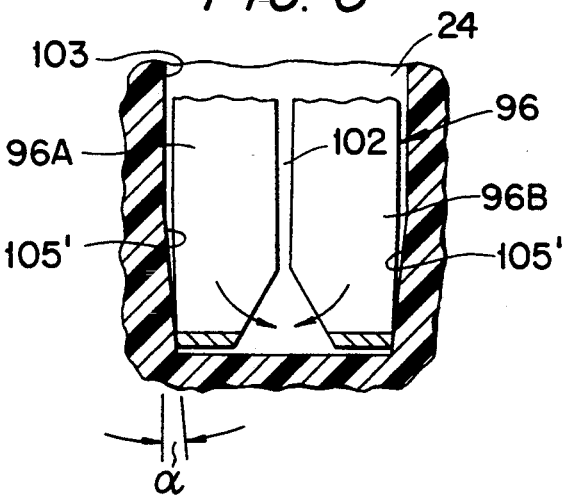
FIG. 6 is a sectional view taken along the line 6—6 in FIG. 4.

It is thus possible to insert into the slots 102, 104, 106 a bare (uninsulated) wire W which is connected to the lamp 22 (see FIG. 4). The slot 102 has a width which is smaller than the diameter of the wire (e.g., smaller by 0.001–0.0019 inches) whereby the rigid sides of the slot 102 cut into the wire, as shown in FIG. 5. In this fashion, any oxide coating on the wire will be removed, to ensure a positive electrical connection between the wire and the metal terminal. This connection is intensified by causing the bottom ends of the two half-sections 96A, 96B of the leg 96 to be squeezed together when the terminal 80 is inserted into the body 26. As depicted in FIG. 6, an inside wall 105 of the aperture 24 necks down at its lower end 105' to slightly bend the half-sections 96A, 96B toward one another, thereby pressing the walls of the slot 102 more tightly against the wire W.

Figure 3:
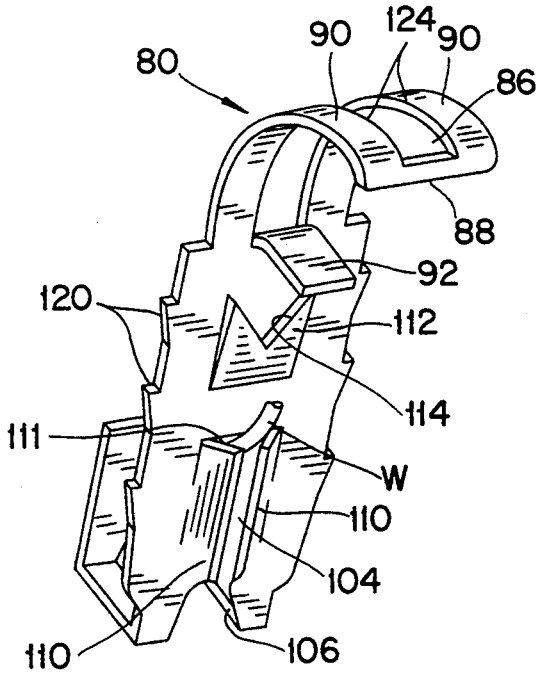
FIG. 3 is a view similar to FIG. 2 of the opposite side of the terminal, and depicting a portion of a wire extending therethrough.

The slot 104 is formed by bending out a pair of partial cut-outs which define spring arms 110. Those spring arms 110 are able to flex elastically as the wire W is slid upwardly therebetween. When the wire reaches the upper end of the slot 104, it exits from between the spring arms 110. The spring arms then snap back, whereby the wire W is nicked between the upper edges of the spring arms and an upper edge 111 of the slot 104 as shown in FIG. 3. Hence, an additional electrical connection is established between the wire and terminal.

It will be appreciated, then, that the two slots 102, 104 cooperate to create a positive electrical coupling of the wire W with the terminal so as to obviate the need for a welding of the wire to the terminal.

The inside wall 105 of the aperture 24 includes a front-to-rear extending channel 118 formed therein for accommodating the tab 92 and the spring arms 110 (see FIG. 4). The channel 118 is slightly deeper at its forward end than at its rearward end. Also, the channel 118 is of V-shaped cross section in the deeper part and rectangular in the shallower rear part.

Formed in side edges of the shank portion 84 are a plurality of forwardly inclined barbs 120 which, when the terminal is pushed into the aperture 24, dig into the inside wall of the aperture 24 to resist forwarded dislodgement of the terminal from the aperture 24.

In practice, the terminals 80 are connected to the wire W by forcing the wire forwardly into the slots 102, 104. The walls of the slot 102 cut through any oxide coating formed on the wire and tightly grip the wire (see FIG. 5), especially due to the squeezing together of the slot walls by the tapering portion 105' of the aperture 24 (see FIGS. 5, 6).

The wire W is nicked between the upper edge 111 of the slot 104 and the upper edges of the spring arms 110 (see FIGS. 3, 4). The forward end of the wire is inserted into the notch 114 of the tab 112.

The lamp 22, and the two terminals 80 are then pushed together as a unit into the aperture 24, with the contact portions 82 of the terminals 80 aligned with the depressions 36 formed in the body 26. If desired, a pushing force can be applied directly to the stop tabs 92. The spring arms 110 and the notched tab 112 enter the channel 118 (see FIG. 4), and the forward end of the wire W becomes pressed between the notched tab and the wall of the channel to be nicked within the notch 114.

Pushing of the terminals 80 terminates when the stop tabs 92 engage the floors of the respective grooves 94 (see FIG. 4). The terminals 80 are thus securely held in the body 26, accidental dislodgement of the terminals being resisted by the barbs 120 which engage an inside wall of the aperture 24.

When the socket 10 is inserted into, or removed, from a circuit plate (as described in greater detail in the aforementioned U.S. Ser No. 08/030,712), the socket is not rotated about the axis A, due to the fact that the snap arms 52A, 52B attain their locking and unlocking positions solely in response to axial movement of the socket.

In the inserted state of the socket 10, the contact portions 82 of the terminals 80 electrically engage the circuit of the circuit plate. Importantly, each contact surface 90 of the contact portion 82 makes its own point contact with the circuit and performs its own wiping action thereacross to remove any oxide coating. Since the contact portion 82 tends to roll out radially away from the axis A as it is compressed, those points of electrical contact move progressively along the contact portion in a direction away from a front edge 88 of the terminal. Since the contact surfaces 90 become more independently movable as the distance from that front end 88 increases, the final contact points will lie on portions of the surfaces 90 which are independently movable to a sufficient extent to provide a two-point contact with the circuit. The shape of the contact portion thus provides two chances for each terminal to make electrical connection with the circuit. If desired, the slot could extend all the way to the front end 88 to fully bifurcate the contact portion 82 and maximize the ability of the surfaces 90 to move relative to one another.

Note that since the socket is not rotated during insertion into or removal from the circuit plate, there is no risk that the edges 124 of the terminal will damage the circuit (as might otherwise result if the contact portion were required to slide across the circuit in a direction transversely of those edges 124).

It will be appreciated that the present invention intensifies the electrical connection of the terminals 80 with the circuit by means of the two contact surfaces 90, and eliminates the need for welding the lamp wires W to the terminals 80 due to the presence of the wire gripping slots 102, 104 and the notched tab 112. Moreover, the stop tabs 92 provide a convenient means of establishing the fully inserted state of each terminal.

Since the terminal/lamp unit 22, 80 can be inserted into the plastic body 26 by pushing directly against the stop tabs 92, that unit can be inserted with less chance of adversely deforming the terminals. If desired, a pushing tool could be provided which passes through the slots 86 to reach the stop tabs 92 since the latter are located in axial alignment with the slots 86.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A socket for receiving a lamp to mount the lamp into a circuit plate which has an opening therethrough for receiving the socket, said socket comprising:

a body forming an aperture which is open at a forward axial end thereof for receiving the lamp, locking means carried by said body for locking said socket to the circuit plate, and electrical terminals disposed on the body for making electrical contact with a circuit carried by the circuit plate, each terminal comprising:

a rear shank portion mounted in said aperture, and a contact portion projecting out of said forward axial end of said aperture and extending radially outwardly from said forward end such that a free end of said contact portion is disposed radially outwardly of said rear shank portion, said contact portion including a through-slot therein extending toward said free end of said contact portion so that said contact portion presents relatively movable contact surfaces on opposite sides of said slot, said contact surfaces facing axially forwardly and disposed radially inwardly of said free end.

2. A socket according to claim 1, wherein each of said forwardly facing contact surfaces is of generally convexly curved configuration.

3. A socket according to claim 1, wherein said through-slot terminates short of said free end of said contact portion.

4. A socket according to claim 1, wherein said body includes flanges projecting radially outwardly from a front end of said aperture, each flange including a radially extending depression, each terminal including a stop tab projecting from a junction of said shank and contact portion, said stop tab lying in said depression.

5. A socket according to claim 1, wherein said locking means comprises snap arms having camming means enabling said body to be installed into, and removed from, the circuit plate without being rotated about its longitudinal axis.

6. A socket according to claim 1, wherein a rear part of said shank portion includes first and second spaced apart legs in which are formed first and second slots, respectively, each slot being open at one end thereof for receiving a wire connected to the lamp, each slot configured to apply a force to said wire for resisting dislodgement thereof.

7. A socket according to claim 3, wherein each of said forwardly facing contact surfaces is of generally convexly curved configuration.

8. A socket for receiving a lamp to mount the lamp into a circuit plate which has an opening therethrough for receiving the socket, said socket comprising:

a body forming an aperture which is open at a forward axial end thereof for receiving the lamp, locking means carried by said body for locking said socket to the circuit plate, and electrical terminals disposed on the body for making electrical contact with a circuit carried by the circuit plate, each terminal comprising:

a rear shank portion mounted in said body, a rear part of said shank portion including first and second spaced apart legs in which are formed first and second slots, respectively, each slot being open at one end thereof for receiving a wire connected to the lamp, each slot configured to apply a force to said wire for resisting dislodgement thereof, and a contact portion projecting forwardly out of said body, said contact portion including a through-slot therein extending toward a forward end of said contact portion so that said contact portion presents relatively movable contact surfaces on opposite sides of said slot.

9. A socket according to claim 8, wherein said rear end of said shank portion is bent into a U-shape to define said legs.

10. A socket according to claim 9, wherein said U-shape includes a bight portion interconnecting said legs, each of said slots being open at a rear end of its respective leg, said bight portion being slotted to interconnect said first and second slots.

11. A socket according to claim 8, wherein one of said slots includes a pair of elastically flexible spring arms which grip said wire, the other of said slots having rigid walls which grip said wire.

12. A socket according to claim 11 including means for squeezing said rigid walls together during insertion of said terminals into said aperture.

13. A socket according to claim 8, wherein said shank portion includes a bent tab disposed between said contact portion and one of said slots, said tab being inclined forwardly and outwardly and including a V-shaped notch formed therein, a forward end of said wire being held in said notch.

14. A socket according to claim 8, wherein said shank portion of each terminal includes barbs engaging an inside wall of said aperture for resisting dislodgement of said terminals from said body.

15. A socket for receiving a lamp to mount the lamp into a circuit plate which has an opening therethrough for receiving the socket, said socket comprising:

a body forming an aperture which is open in a forward axial direction for receiving the lamp, locking means carried by said body for locking said socket to the circuit plate, and electrical terminals disposed on the body for making electrical contact with a circuit carried by the circuit plate, each terminal comprising:

a contact portion projecting forwardly from said body, and a shank portion mounted in said body, a rear end of said shank portion including first and second spaced apart legs in which are formed first and second slots, respectively, each slot being open at one end thereof for receiving a wire connected to the lamp, each slot configured to apply a force to said wire for resisting dislodgement thereof.

16. A socket according to claim 15, wherein said rear end of said shank portion is bent into a U-shape to define said legs.

17. A socket according to claim 16, wherein said U-shape includes a bight portion interconnecting said legs, each of said slots being open at a rear end of its respective leg, said bight portion being slotted to interconnect said first and second slots.

18. A socket according to claim 15, wherein one of said slots comprises a pair of elastically flexible springs arms which grip said wire.

19. A socket according to claim 18, wherein the other of said slots has rigid walls which grip said wire.

20. A socket according to claim 19 including means for squeezing said walls together during insertion of said terminals into said aperture.

21. A socket according to claim 15, wherein said wire comprises an uninsulated wire.

22. A socket according to claim 15, wherein said shank includes a bent tab disposed between said contact portion and one of said slots, said tab being inclined forwardly and outwardly and including a V-shaped notch formed therein, a forward end of said wire being held in said notch.

23. A socket according to claim 15, wherein said shank portion of each terminal includes barbs engaging said body portion for resisting dislodgement of said terminals from said body.

* * * * *